US008400882B2

(12) United States Patent
Cunningham

(10) Patent No.: US 8,400,882 B2
(45) Date of Patent: Mar. 19, 2013

(54) MEMENTO TIMEPIECE SYSTEMS

(76) Inventor: Matthew B. Cunningham, Phoenix, AZ (US)

( * ) Notice: Subject to any disclaimer, the term of this patent is extended or adjusted under 35 U.S.C. 154(b) by 1873 days.

(21) Appl. No.: 11/165,965

(22) Filed: Jun. 24, 2005

(65) Prior Publication Data

US 2006/0007788 A1 Jan. 12, 2006

Related U.S. Application Data

(60) Provisional application No. 60/587,639, filed on Jul. 12, 2004.

(51) Int. Cl.
*G04B 23/02* (2006.01)

(52) U.S. Cl. ..... 368/73

(58) Field of Classification Search ..... 368/73, 368/72

See application file for complete search history.

(56) References Cited

U.S. PATENT DOCUMENTS

| | | | | |
|---|---|---|---|---|
| 1,520,790 | A * | 12/1924 | Wier | 33/270 |
| 4,396,293 | A | 8/1983 | Mizoguchi | |
| 4,504,153 | A * | 3/1985 | Schollmeyer et al. | 368/10 |
| 4,601,584 | A * | 7/1986 | DeWolf et al. | 368/10 |
| 4,659,231 | A | 4/1987 | Barkouki | |
| 6,069,848 | A * | 5/2000 | McDonald et al. | 368/107 |
| 6,164,814 | A * | 12/2000 | Crow | 368/276 |
| 6,202,035 | B1 | 3/2001 | Lameer | |
| 6,229,430 | B1 | 5/2001 | Smith Dewey | |
| 6,238,084 | B1 | 5/2001 | Blotky et al. | |
| 6,540,519 | B2 | 4/2003 | Wexler | |
| 6,633,796 | B1 * | 10/2003 | Pool et al. | 700/231 |
| 6,705,919 | B2 * | 3/2004 | Curran et al. | 446/484 |
| 6,714,486 | B2 | 3/2004 | Biggs | |
| 7,012,856 | B2 * | 3/2006 | Kibiloski et al. | 368/47 |
| 7,204,694 | B2 * | 4/2007 | Delvecchio et al. | 434/246 |
| 2003/0002390 | A1 | 1/2003 | Sellen et al. | |
| 2003/0002391 | A1 * | 1/2003 | Biggs | 368/82 |
| 2003/0189877 | A1 | 10/2003 | Bubar | |
| 2003/0198138 | A1 * | 10/2003 | Shebani | 368/21 |
| 2004/0013043 | A1 | 1/2004 | Haq | |
| 2005/0007884 | A1 * | 1/2005 | Lorenzato | 368/10 |
| 2005/0026120 | A1 * | 2/2005 | Delvecchio et al. | 434/236 |

OTHER PUBLICATIONS

St. Joseph Catholic Community—Lent and Easter :: stjosepheldersburg.org/other/seasons/lent2001.shtml; Nov. 10, 2001.*

* cited by examiner

*Primary Examiner* — Sean Kayes
(74) *Attorney, Agent, or Firm* — Stoneman Law Patent Group; Martin L. Stoneman

(57) ABSTRACT

A memento timepiece system adapted to assist an individual in the daily observance of at least one daily event memorable to the individual. Many individuals have within their experience, a person, life event, or other occasion that they wish to remember daily, weekly or monthly. The present invention comprises a timepiece, such as a wristwatch, having a factory preset alarm time to mark a daily act of remembrance. Business methods relating to the manufacture and distribution of the memento timepiece systems are also disclosed.

1 Claim, 8 Drawing Sheets

MEMENTO TIMEPIECE SYSTEMS

CROSS-REFERENCE TO RELATED APPLICATION

The present application is related to and claims priority from prior provisional application Ser. No. 60/587,639, filed Jul. 12, 2004, entitled "MEMENTO TIMEPIECE SYSTEMS", the contents of which are incorporated herein by this reference and are not admitted to be prior art with respect to the present invention by the mention in this cross-reference section.

BACKGROUND

This invention relates to memento timepiece systems. More particularly, this invention relates to memento timepiece systems adapted to assist in the daily observance of at least one event memorable to the individual.

History exists through perceptible links created by individuals or groups to a past person or event. Many individuals have, within their experience, a person, life event, or other occasion that they wish to remember daily, weekly or monthly. For example, remembering daily the 3 p.m. time of Christ's death or the 9/11 events of 2001 is important to many people. Such remembrances often include a moment of prayer, silence or other such honoring act. Often an individual or group will perform such remembrances at a specific time within the day.

It is clear, based on the above discussion, that a need exists for systems adapted to assist an individual or group of individuals in a daily act of remembrance by alerting the individual at least one specific pre-set time within the day. Furthermore, a system that is easily carried with the individual and available to alert the individual would be useful.

OBJECTS AND FEATURES OF THE INVENTION

A primary object and feature of the present invention is to overcome the above-mentioned problems and fulfill the above-mentioned needs.

It is a further object and feature of the present invention to provide a timekeeper system to assist an individual in a daily act of remembrance by alerting the user at a specific pre-set time or times within the day, preferably with respect to a 24-hour timekeeper time-of-day.

It is another object and feature of the present invention to provide a system that is easily carried by the user as a personal item.

It is another object and feature of the present invention to provide a system that "pre-sets" the time of remembrance at the factory by the manufacturer.

It is another object and feature of the present invention to provide a system that provides the user with current time and the current date data.

It is another object and feature of the present invention to provide a system that comprises a wristwatch.

It is another object and feature of the present invention to provide a wearable timekeeper system having indicia thereon having a relation to the occasion of the remembrance to be acted upon.

It is another object and feature of the present invention to provide a system that comprises a wearable housing of a size and weight that permits the device to be supported by the body of the user.

It is another object and feature of the present invention to provide a system that receives wireless time data from a remote source.

It is another object and feature of the present invention to provide a method of producing custom memento timepieces.

It is an additional object and feature of the present invention to provide a method of providing memento timepieces, at a wholesale price, to assist non-profit groups in fund-raising efforts.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides memento timepiece systems, relating to at least one daily observance of at least one event memorable to at least one user, comprising: timekeeper means for keeping current time-of-day data; alerter means for providing at least one daily user alert as at least one memento of the at least one event memorable to the at least one user; and alert initiator means, coupled with such alerter means and coupled with such timekeeper means, for initiating the at least one daily user alert by such alerter means; wherein such alert initiator means further comprises factory presetter means for factory presetting, in a manner not user-modifiable, the initiating of the at least one daily user alert, as the at least one memento of the at least one event memorable to the at least one user, at at least one preset daily time-of-day according to such timekeeper means; and wherein the at least one preset daily time-of-day defines from one to about ten preset times of day, most preferably exactly one time of day.

Moreover, it provides such memento timepiece systems further comprising housing means for housing such timekeeper means, such alerter means, and such alert initiator means. Additionally, it provides such memento timepiece systems wherein such housing means comprises wearability means for assisting wearability of such housing means adjacent at least one portion of the body of the at least one user. Also, it provides such memento timepiece systems further comprising indicia means for visually depicting at least one memorable aspect of the event memorable to the at least one user. In addition, it provides such memento timepiece systems further comprising user operable suppressor means for user operable suppression of the at least one daily user alert. And, it provides such memento timepiece systems wherein such time keeper means comprises date keeper means for keeping current calendar date data.

In accordance with another preferred embodiment hereof, this invention provides memento timepiece systems, relating to at least one daily observance of at least one event memorable to at least one user, comprising: at least one timekeeper adapted to keep current time-of-day data; at least one alerter adapted to provide at least one daily user alert as at least one memento of the at least one event memorable to the at least one user; and at least one alert initiator, coupled with such at least one alerter and coupled with such at least one timekeeper, adapted to initiate the at least one daily user alert by such at least one alerter; wherein such at least one alert initiator further comprises at least one factory presetter adapted to factory preset, in a manner not user-modifiable, the initiating of the at least one daily user alert, as the at least one memento of the at least one event memorable to the at least one user, at at least one daily set time-of-day according to such at least one timekeeper; and wherein the at least one daily set time-of-day according to such at least one timekeeper comprises a number from one to about ten.

Further, it provides such memento timepiece systems further comprising indicia to visually depict at least one memorable aspect of the event memorable to the at least one user. Even further, it provides such memento timepiece systems wherein such indicia visually reminds the at least one user of at least one event of the Christian religion. Moreover, it provides such memento timepiece systems further comprising at least one user operable suppressor adapted to permit user operable suppression of the at least one user alert. Additionally, it provides such memento timepiece systems wherein such at least one timekeeper comprises at least one date keeper adapted to keep current calendar-date data. Also, it provides such memento timepiece systems wherein such at least one factory presetter is factory presettable to initiate the at least one user alert at any time-of-day. In addition, it provides such memento timepiece systems wherein such at least one factory presetter is factory presettable to initiate the at least one user alert at about the three-o'clock hour. And, it provides such a memento timepiece systems further comprising at least one housing adapted to house such at least one timekeeper, such at least one alerter and such at least one alert initiator. Further, it provides such memento timepiece systems wherein such at least one housing comprises at least one wearable element to assist wearable support of such at least one housing adjacent at least one body portion of the at least one user.

Even further, it provides such memento timepiece systems wherein such at least one wearable element comprises at least one wristband assembly adapted to assist wearable support of such at least one housing adjacent to at least one arm portion of the at least one user. Moreover, it provides such memento timepiece systems wherein such at least one wearable element comprises at least one lanyard assembly adapted to assist wearable support of such at least one housing about at least one neck portion of the at least one user. Additionally, it provides such memento timepiece systems wherein such at least one wearable element comprises at least one attacher structured and arranged to permit attachability of such at least one housing to at least one article of clothing of the at least one use.

In accordance with another preferred embodiment and methods hereof, this invention provides business methods relating to the daily observance of at least one event memorable to a plurality of individuals, comprising the steps of: identifying such at least one event memorable to such plurality of individuals; providing for the manufacture of memento timepiece systems providing at least one daily reminder of such at least one event memorable to such plurality of individuals; operating at least one site offering to sell such memento timepiece systems; providing for acceptance of orders and payment from at least one of such plurality of individuals for such memento timepiece systems; and providing for shipping such ordered memento timepiece systems to such at least one of such plurality of individuals wherein each of such memento timepiece systems comprises at least one timekeeper adapted to keep current time-of-day data, at least one alerter adapted to provide at least one daily user alert as at least one memento of the at least one event memorable to the at least one user, and at least one alert initiator, coupled with such at least one alerter and coupled with such at least one timekeeper, adapted to initiate the at least one daily user alert by such at least one alerter, wherein such at least one alert initiator further comprises at least one factory presetter adapted to factory preset, in a manner not user-modifiable, the initiating of the at least one daily user alert, as the at least one memento of the at least one event memorable to the at least one user, at at least one preset daily time-of-day, and wherein the at least one preset daily time-of-day defines from one to about ten preset times of day, most preferably exactly one time of day.

Also, it provides such business methods further comprising the steps of: accepting at least one custom order for such memento timepiece systems to provide at least one daily reminder of at least one event memorable to a specific individual; and providing for the manufacture of such custom memento timepiece systems. In addition, it provides such business methods wherein such at least one site comprises an Internet site operated in conjunction with at least one website server.

In accordance with another preferred embodiment and methods hereof, this invention provides business methods relating to the daily observance of at least one event memorable to members of at least one non-profit group, comprising the steps of: identifying such at least one event memorable to such members of the at least one non-profit group; providing for the manufacture of memento timepiece systems providing at least one daily reminder of such at least one event memorable to such members of the at least one non-profit group; operating at least one site offering to sell such memento timepiece systems to such members of the at least one non-profit group; providing for acceptance of orders and payment from at least one of such members for such memento timepiece systems, at a wholesale rate, essentially to assist such at least one non-profit group to carry out at least one revenue producing resale of such memento timepiece systems; and providing for shipping such ordered memento timepiece systems to such members of such at least one non-profit group wherein each of such memento timepiece systems comprises at least one timekeeper adapted to keep current time-of-day data, at least one alerter adapted to provide at least one daily user alert as at least one memento of the at least one event memorable to the at least one user, and at least one alert initiator, coupled with such at least one alerter and coupled with such at least one timekeeper, adapted to initiate the at least one daily user alert by such at least one alerter, wherein such at least one alert initiator further comprises at least one factory presetter adapted to factory preset, in a manner not user-modifiable, the initiating of the at least one daily user alert, as the at least one memento of the at least one event memorable to the at least one user, at at least one daily set time-of-day according to such at least one timekeeper, and wherein the at least one daily set time-of-day according to such at least one timekeeper comprises a number from one to about ten.

And, it provides such a business methods wherein such at least one site comprises an Internet site operated in conjunction with at least one website server. Furthermore, this invention provides each and every novel feature, element, combination, step and/or method disclosed or suggested by this provisional patent application.

DETAILED DESCRIPTION OF THE BEST MODES AND PREFERRED EMBODIMENTS OF THE INVENTION

The following definitions are provided to facilitate understanding of certain terms used frequently herein. The explanation is provided as a convenience and is not limitative of the invention.

In the present disclosure, the term "memento" is defined as one (or more) apparatus or structure established to remind an individual or group of individuals of a person or event.

The term "timepiece" is defined as a device (such as a clock or watch) to measure or show progress of time.

The terms "alert" or "alert signal" are each defined as a means (such as a sound, visible indicator, or perceptible movement) for conveying notice. Further, these terms shall include alerting means having both essentially instantaneous and extended durations (as in a grouping of audible tones lasting one minute).

In the accompanying drawings, some structures and devices may be shown in block diagram form in order to provide an understanding of the interrelationship between components and the flow of information and control throughout the depicted preferred embodiment of the present invention. Upon reading the applicant's specification, it will be apparent to those skilled in the art from the teachings herein that the invention may be practiced with a variety of different specific components provided to serve the generalized block diagram description.

Figure 1:
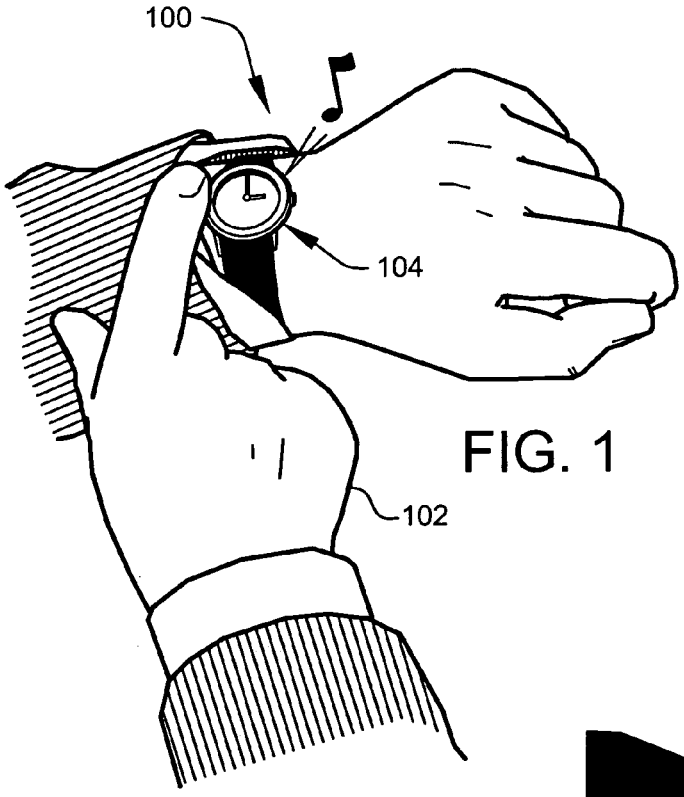
FIG. 1 shows a perspective view illustrating a memento timepiece system, alerting a user at a pre-set time, according to a preferred embodiment of the present invention.

FIG. 1 shows a perspective view illustrating memento timepiece system 100, alerting user 102 to a pre-set time of remembrance, according to a preferred embodiment of the present invention. Memento timepiece system 100 preferably comprises a physical arrangement adapted to permit user 102 to carry memento timepiece system 100 adjacent to the body as a personal object, as shown. Memento timepiece system 100 most preferably comprises a wearable wristwatch 104, as shown.

Preferably, memento timepiece system 100 comprises at least one alerting component adapted to produce an alerting signal such as the audible chime shown. Preferably, for user convenience, the times at which memento timepiece system 100 generates the alerting signal is pre-set at the factory and, in general, is not adjustable by the user. By the term "factory presetting" (and the like) when used in this specification is meant that the action occurs during at least one manufacturing and/or assembly process. Preferably, memento timepiece system 100 is factory programmed to provide an alerting signal at at least one specific time during a day, most preferably at one daily time. For example, memento timepiece system 100 may be factory programmed to generate a one-minute alert signal at 3:00 p.m. each day to assist user 102 in remembering the time of Christ's death. Preferably, to accommodate a range of memorial events, memento timepiece system 100 is factory-programmable to provide between one alert signal and about ten alert signals within a single 24-hour period (at least embodying herein at least one preset daily time-of-day; and further at least embodying herein wherein the at least one preset daily time-of-day defines from one to about ten preset times of day), preferably exactly one time of day (at least embodying herein at least one factory presetter is factory presettable to initiate exactly one daily user alert at about the three-o'clock PM hour). Preferably, memento timepiece system 100 provides user 102 with at least one means for stopping or suspending the alert signal when an alert is not desired (such as during a meeting, movie, period of sleep, etc.).

Figure 2:
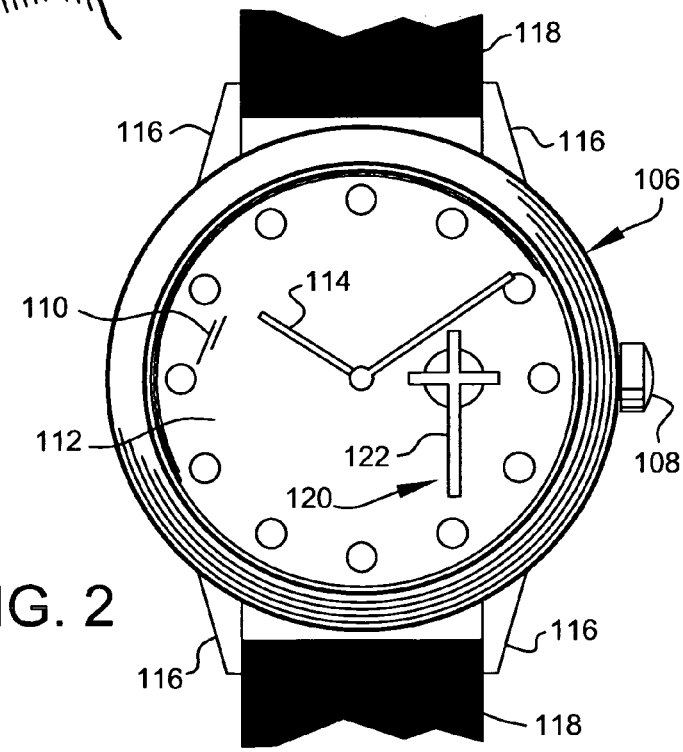
FIG. 2 shows a partial front view of the memento timepiece system according to the preferred embodiment of FIG. 1.

FIG. 2 shows a partial front view of memento timepiece system 100 according to the preferred embodiment of FIG. 1. Preferably, memento timepiece system 100 generally comprises many of the external features of a conventional watch including; outer case 106 (at least embodying herein housing means), adjustment crown 108, transparent crystal 110, dial 112, handset 114 (hour, minute and second), lugs 116, and band 118, as shown. Preferably, adjustment crown 108 is adapted to permit time adjustment of the internal timekeeping movement. Upon reading the teachings of this specification, those of ordinary skill in the art will now understand that, under appropriate circumstances, given such issues as user preference, timepiece configuration, etc., using the adjustment crown to perform additional functions, such as winding, silencing the alert signal, adjusting the current date, etc, may suffice.

Preferably, memento timepiece system 100 comprises memento indicia 120, as shown. Preferably, memento indicia 120 provide a visual connection to the person or event to be remembered thereby assisting user 102 in the act of remembrance (at least embodying herein indicia means for visually depicting at least one memorable aspect of the event memorable to the at least one user). Preferably, the outward appearance of memento indicia 120 are selected based on a visual association with the person or event to be remembered. If memento timepiece system 100 is used to assist user 102 in a religious observation, memento indicia 120 may preferably comprise a traditional symbol or common phrase drawn from the religion's traditions and practices. For example, the memento indicia 120 of FIG. 2 comprises Christian cross 122, used as a symbolic representation of the crucifixion and resurrection of Jesus Christ. Preferably, one or more memento indicia 120 are applied to a visible external portion of memento timepiece system 100, such as the face of dial 112, as shown. Upon reading the teachings of this specification, those of ordinary skill in the art will now understand that, under appropriate circumstances, considering such issues as user preference, physical shape, intended use, etc., other indicia locations, such as the outer case, bezel, crystal, band, back, etc., may suffice.

Figure 3:
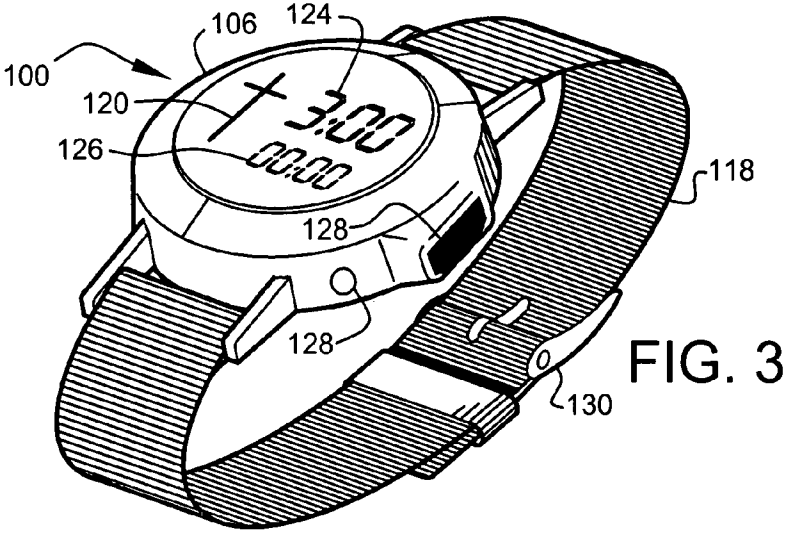
FIG. 3 shows a perspective view, illustrating another embodiment of the memento timepiece system, according to the preferred embodiment of FIG. 1.

FIG. 3 shows a perspective view, illustrating a variation of memento timepiece system 100, according to the preferred embodiments of FIG. 1. Preferably, memento timepiece system 100 is adaptable to provide an analog display (with hands and dial as illustrated in FIG. 1), or electronic display 124 with time data displayed in digits, as shown, or a combination of both. Electronic display 124 may preferably comprise an arrangement of Light Emitting Diodes (LEDs) or Liquid Crystal Display (LCD), as shown. Electronic display 124 is especially applicable to timepiece arrangements used in sport-type watches, as shown.

Preferably, memento timepiece system 100 may be adaptable to include the display of current date 126, as shown (at least embodying herein wherein such timekeeper means comprises date keeper means for keeping current calendar date data). Upon reading the teachings of this specification, those of ordinary skill in the art will now understand that, under appropriate circumstances, such as user preference, intended use, etc., the inclusion of other display functions, such as stopwatch operations, analog/digital display combinations, pulse rate monitoring, GPS positioning, temperature indication, numerical data messaging, etc., may suffice.

As in the prior figures, memento timepiece system 100 preferably comprises memento indicia 120, as shown. Preferably, memento timepiece system 100 of FIG. 3 comprises external controls 128 (that may preferably include adjustment crown 108 of FIG. 1) to permit the user to set the current time and date along with other secondary features, if any, of the watch, as shown. It is again noted that, for user convenience, the timing of the alerting signal is factory pre-set and, in general, is only adjustable by the user to the extent of its dependence on the user settable current time and/or date (at least embodying herein wherein such alert initiator means further comprises factory presetter means for factory presetting, in a manner not user-modifiable, the initiating of the at least one daily user alert).

Preferably, band 118 (at least embodying herein wherein such at least one wearable element comprises at least one wristband assembly adapted to assist wearable support of such at least one housing adjacent to at least one arm portion of the at least one user) comprises clasp 130 adapted to permit memento timepiece system 100 to be easily secured and removed from the wrist of the user. Upon reading the teachings of this specification, those of ordinary skill in the art will now understand that, under appropriate circumstances, such as user preference, intended use, etc., the use of other fastening configurations, such as elastic, hook and loop, etc., may suffice.

Figure 4:
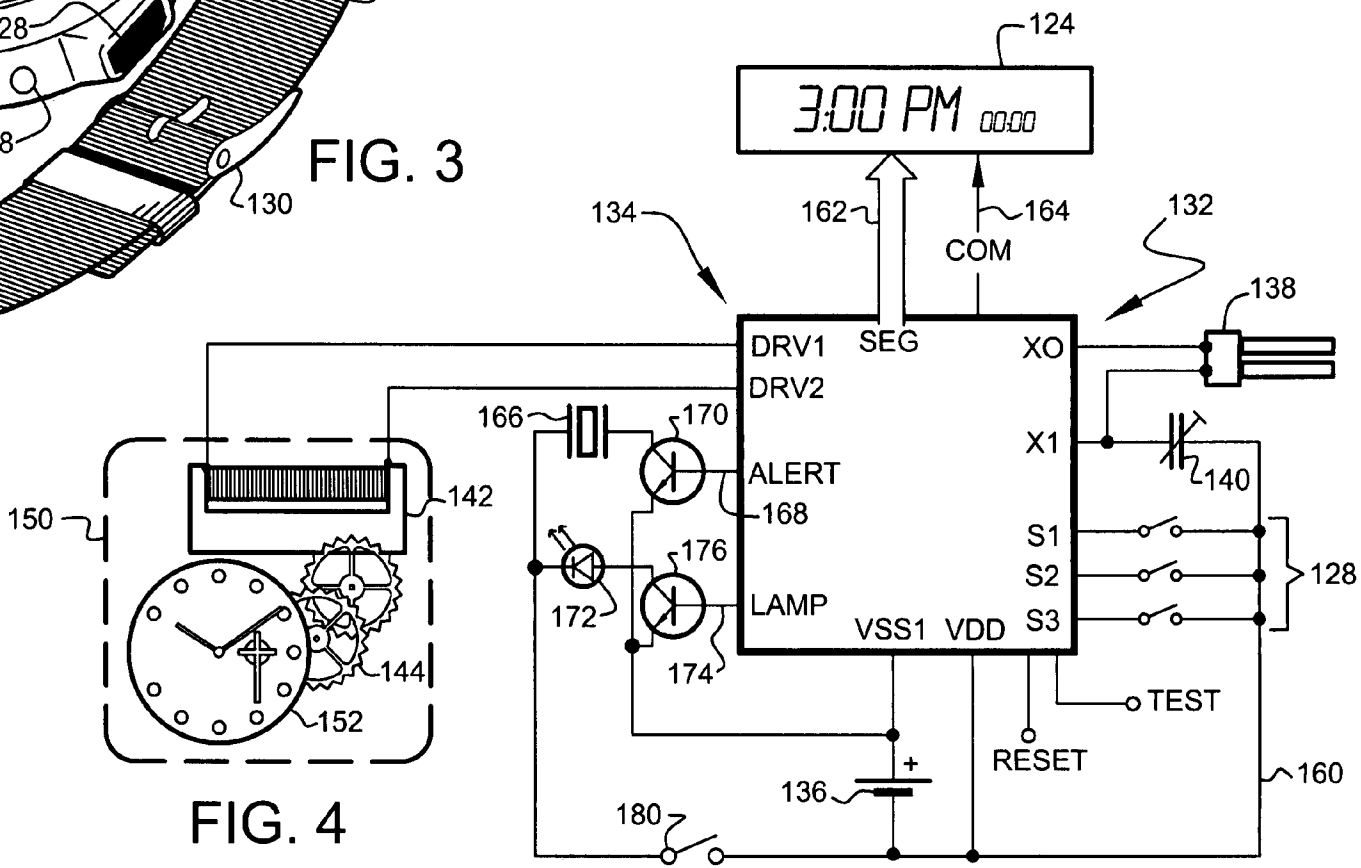
FIG. 4 shows a block diagram, generally illustrating the internal component arrangements of the memento timepiece system, according to the preferred embodiment of FIG. 1.
Figure 5:
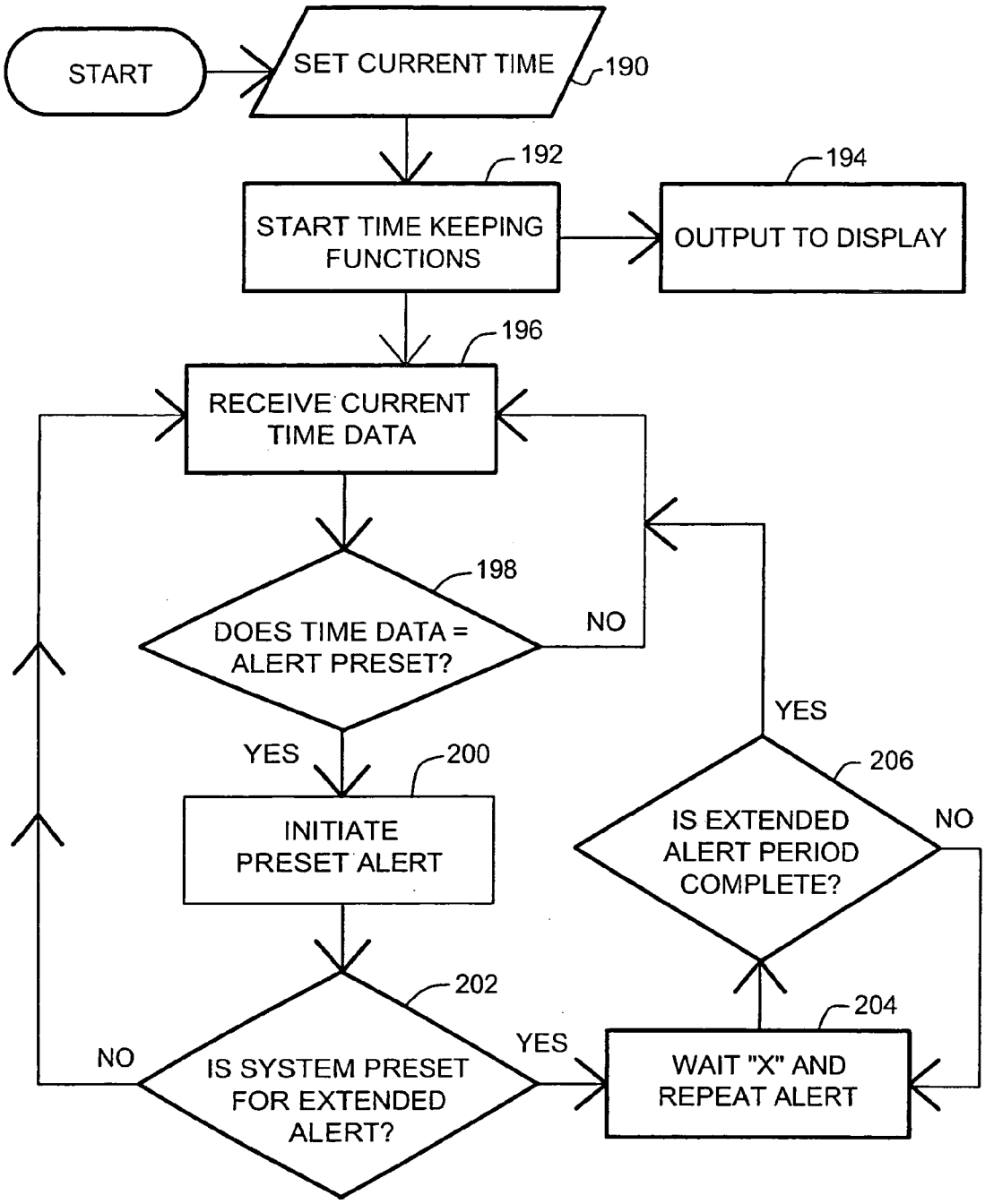
FIG. 5 shows a flowchart diagram, generally illustrating the novel operational aspects of the memento timepiece system, according to the preferred embodiments of the present invention.

FIG. 4 shows a block diagram, generally illustrating the internal component arrangements of memento timepiece system 100, according to the preferred embodiments of FIG. 1 through FIG. 3. Preferably, memento timepiece system 100 comprises timekeeping movement 132 (at least embodying herein timekeeper means for keeping current time-of-day data), protectively housed within outer case 106. Preferably, timekeeping movement 132 is adapted to maintain current time and date data, initiate the factory preset alarm signals and control other secondary functions of the system, if any, as applicable. Timekeeping movement 132 preferably comprises a quartz movement having an integrated circuit controller 134, coupled to quartz resonator 138, as shown.

Preferably, power cell 136 is adapted to provide electrical power to the timing circuit and is preferably electrically coupled to integrated circuit controller 134 and power bus 160, as shown. Preferably, power cell 136 comprises a silver oxide type cell delivering about 1.5 volts. Upon reading the teachings of this specification, those of ordinary skill in the art will now understand that, under appropriate circumstances, such as user preference, advances in technology, intended use, etc., the use of other cell types, such as longer-lasting 3 volt lithium batteries, solar cells, etc., may suffice.

Preferably, integrated circuit controller 134 comprises a programmable, board-mounted Complementary Metal Oxide Semiconductor Integrated Circuit (CMOS IC) device. Depending on the specifics of the application, the CMOS device may comprise an analog, digital, or mixed signal semiconductor design. Integrated circuit controller 134 may comprise at least one internal logic processor that may comprise well-known logic structures such as registers for arithmetic operation, address control registers, stack pointers, instruction registers, instruction decoders, etc. Preferably, the internal logic processor is electrically coupled with peripheral circuits by means of internal address and data buses. Preferably, integrated circuit controller 134 further comprises factory installed software programming adapted to operate the internal logic processor. Preferably, data memory, more preferably comprising Random Access Memory (RAM), is used by integrated circuit controller 134 to hold the current time and timer data.

Preferably, integrated circuit controller 134 (at least embodying herein alert initiator means, coupled with such alerter means and coupled with such timekeeper means, for initiating the at least one daily user alert by such alerter means) comprises at least one commercially available watch circuit adapted for use in battery operated wrist watches, preferably using a 32 kHz quartz resonator as the timing element, preferably modified to provide the alerting signals of the present invention, as described below.

Preferably, quartz resonator 138 comprises a tuning-fork-shaped quartz crystal (silicon dioxide) that is laser-trimmed or precision lapped to vibrate at about 32,768 cycles per second. Standard quality resonators of this type are generally warranted to have a long-term accuracy of about 6 parts per million at 31 degrees Celsius, that is, memento timepiece system 100 is expected to gain or lose less than one-half second per day while operating at the body temperature of user 102. Preferably, quartz resonator 138 is electrically coupled to an oscillator driver circuit, within integrated circuit controller 134, and to power bus 160, as shown. Preferably, the oscillator driver circuit is adapted to maintain quartz resonator 138 at its resonant frequency of 32.768 KHz.

Preferably, an accessibly located frequency regulating trimmer 140 is used within the timing circuit to permit small frequency adjustments to quartz resonator 138, typically within the limits of about plus-or-minus-two seconds per day. In addition, integrated circuit controller 134 preferably comprises an internal divider circuit adapted to divide down the quartz frequency from 32.768 KHz to a usable one pulse per second.

Analog display embodiments of memento timepiece system 100 preferably comprise mechanical sub-assembly 150, preferably containing a stepping motor 142, gear train 144 and analog display 152, as shown. Preferably, a stepping motor driver circuit, within integrated circuit controller 134, is adapted to deliver timed voltage pulses (preferably one per second) to drive stepping motor 142, as shown. Preferably, stepping motor 142 is mechanically coupled to gear train 144 that operates analog display 152, as shown.

Preferably, user controllable functions of integrated circuit controller 134 are accessible using external controls 128 (see also FIG. 3), preferably comprising a bank of normally open momentary-contact switches, as shown. Preferably, external controls 128 are electrically coupled to integrated circuit controller 134 and power bus 160, as shown. Upon reading the teachings of this specification, those of ordinary skill in the art will now understand that, under appropriate circumstances, such as user preference, advances in technology, intended use, etc., other methods of user access to system function, such as via the adjustment crown, may suffice.

Preferably, integrated circuit controller 134 comprises first LCD data path 162 comprising segment output pins for a muliplex LCD display (electronic display 124), as shown. Additionally, integrated circuit controller 134 comprises second LCD output path 164 preferably comprising common output pins for the muliplex LCD display (electronic display 124), as shown.

Preferably, timekeeping movement 132 comprises at least one audible alerting component 166, as shown (at least embodying herein alerter means for providing at least one daily user alert as at least one memento of the at least one event memorable to the at least one user). Preferably, audible alerting component 166 comprises an electronic chime or piezo buzzer, as shown. Preferably, audible alerting component 166 is controlled by audible alert output pin 168 on integrated circuit controller 134 (programmable to factory-pre-set at least one time of initiation, preferably exactly one time of initiation, of audible alerting component 166), as shown. Preferably, audible alert output pin 168 is electrically coupled to switching transistor 170 preferably adapted to control the delivery of power between audible alerting component 166, power cell 136 and power bus 160, as shown.

In a similar preferred arrangement, embodiments of timekeeping movement 132 may, under appropriate circumstances, comprise at least one visual alerting component 172, as shown (at least embodying herein alerter means for providing at least one daily user alert as at least one memento of the at least one event memorable to the at least one user). Preferably, visual alerting component 172 comprises an LED or similar lamp, as shown. Preferably, visual alerting component 172 is controlled by visual alert output pin 174 on integrated circuit controller 134, as shown. Preferably, visual alert output pin 174 is electrically coupled to switching transistor 176 preferably adapted to control the delivery of power between visual alerting component 172, power cell 136 and power bus 160, as shown. Upon reading the teachings of this specification, those of ordinary skill in the art will now understand that, under appropriate circumstances, considering such issues as circuit design and component selection, other electronic configurations, such as driving the alerting components directly from the IC controller, may suffice. Furthermore, upon reading the teachings of this specification, those of ordinary skill in the art will now appreciate that, under appropriate circumstances, such as user preference, advances in technology, intended use, etc., the use of other alerting devices, such as vibrators, digital text display, etc., may suffice.

Preferably, a user controllable switch 180 (at least embodying herein user operable suppressor means for user operable suppression of the at least one daily user alert) is provided between the power bus 160 and the alerting devices to permit the user to suspend or suppress the operation of audible alerting component 166 (at least embodying herein wherein said at least one alerter comprises at least one audio signal) and/or visual alerting component 172, (at least embodying herein wherein said at least one alerter comprises at least one visual signal) as shown.

Upon reading the teachings of this specification, those of ordinary skill in the art will now understand that, under appropriate circumstances, considering such issues as user preference, intended use, etc., other system controls for integrated circuit controller, such as reset pins, and/or test pins, may suffice. Furthermore, those of ordinary skill in the art will now understand that, under appropriate circumstances, considering such issues as user preference, advances in technology, intended use, etc., other electronic control arrangements, such as single-chip devices, movements entirely mechanically operated, systems comprising radio controlled setting functions, etc., may suffice.

Watch movements suitable for modification and use with the present invention are available through a number of commercial sources. For example, a single-chip CMOS LSI model JT9692A-AS manufactured by Toshiba Electronics (www.Toshiba.com) is modifiable for use with the present invention.

With continued reference to FIG. 1 through FIG. 4, FIG. 5 is a flowchart diagram, generally illustrating the novel operational aspects of memento timepiece system 100, according to the preferred embodiments of the present invention. Preferred operation of memento timepiece system 100 begins with the setting of the current time (for example by user 102) as depicted in step 190. Upon reading the teachings of this specification, those of ordinary skill in the art will now understand that, under appropriate circumstances, considering specifics of the embodiment, intended use, etc., other steps of operating the memento timepiece system, such as the setting of other system functions, such as, setting the current date, setting the time zone, setting the secondary alarms, etc, may suffice. Preferably, on completion of step 190, timekeeping movement 132 begins continuous operation to keep current time data, as depicted in step 192. Preferably, as described in FIG. 4 above, timekeeping movement 132 is adapted to output the current time data to one or more displays (analog and/or digital), as depicted in adjacent step 194.

Preferably, integrated circuit controller 134 of timekeeping movement 132 comprises an internal logic processor structured and arranged to receive and process the current time data, as depicted in steps 196 and 198. Preferably, integrated circuit controller 134 comprises a program that directs integrated circuit controller 134 to receive current time data from the timekeeping circuit as depicted in step 196. Preferably, as depicted in step 198, the current time data is compared to factory-preset alert signal times, preferably stored in program memory. If the current time data equals at least one of the factory-preset alert times, the program preferably executes step 200. If the current time data does not equal one of the factory-preset alert times, the program preferably returns to step 196, and directs integrated circuit controller 134 to receive the next current time data sample for comparison.

On executing step 200, the program preferably initiates the user alert and executes step 202, as shown. Next, as depicted in step 202, the program preferably checks for an extended alert signal routine. For example, the program may comprise a preset alert signal routine having a start chime followed by an end chime at the end of one minute. If the factory-preset program comprises an extended alert signal routine, the program preferably executes step 204, as shown. If the factory-preset program does not comprise an extended alert signal routine, the program preferably returns to step 196, as shown.

On reaching step 204, the software program of integrated circuit controller 134 again preferably samples time data from the timekeeping circuit to initiate a preset wait period before repeating the user alert signal, as shown. On executing the second user alert signal, the program preferably performs a check, using new current time data, to determine if the factory-preset alert period is complete, as depicted in step 206. If the factory-preset alert period is complete, the program preferably returns to step 196. If the factory-preset alert period is not complete, the program again executes step 204, as shown. Preferably, step 206 is repeated until the condition of step 206 is true and the program preferably returns the system to step 196, as shown. Upon reading the teachings of this specification, those of ordinary skill in the art will now understand that, under appropriate circumstances, considering such issues as user preference, timepiece configuration, intended use, etc., the inclusion of other operational steps may suffice. For example, an additional programmed decision step, to determine if the user has electronically enabled or suppressed the factory-preset alert signal, may be included between step 198 and step 200. If the additional decision step were included, the program would preferably return to step 196 on determining that the user had suppressed the alert signal or proceed to execute step 200 on determining that the user had enabled the alert signal.

Figure 6:
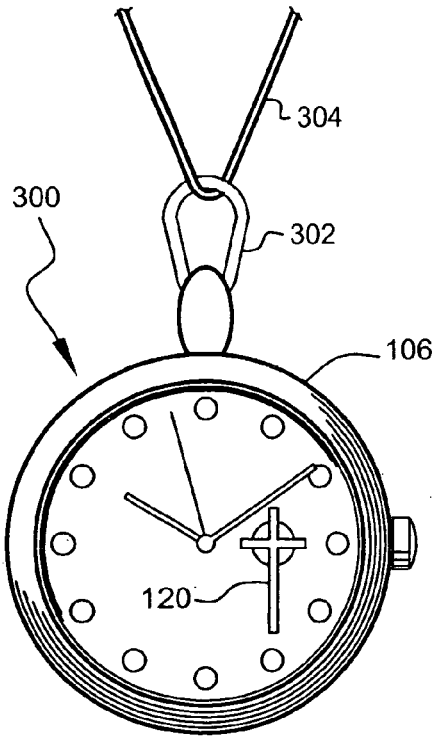
FIG. 6 shows a partial front view of the memento timepiece system according to another preferred embodiment of the present invention.

FIG. 6 through FIG. 13 depict various embodiments of the present invention to illustrate the adaptability of the memento timepiece system FIG. 6 shows a partial front view of memento timepiece system 300 according to another preferred embodiment of the present invention. Preferably, the memento timepiece system is adaptable to provide a wide range of wearable options. Preferably, memento timepiece system 300 comprises a pendant-style timepiece, adaptable to be worn about the neck of the user. Preferably, memento timepiece system 300 comprises an outer case 106 with ring assembly 302, adapted to be suspended from lanyard 304 (a cord or chain), as shown (at least embodying herein wherein such housing means comprises wearability means for assisting wearability of such housing means adjacent at least one body portion of the at least one user).

Figure 7:
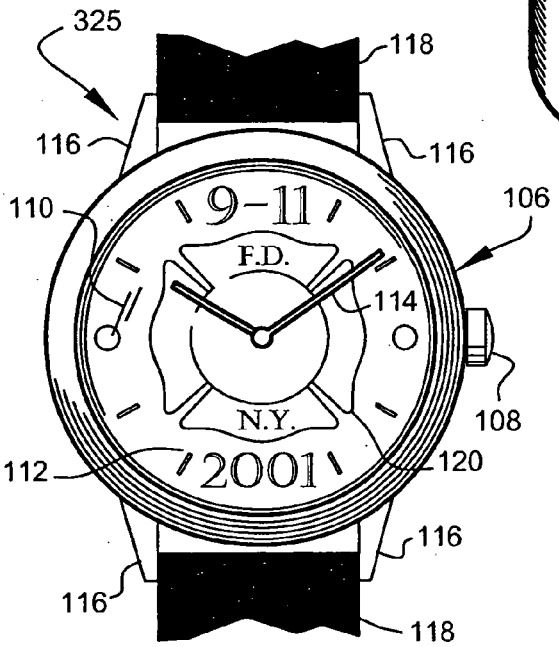
FIG. 7 shows a partial front view of the memento timepiece system according to another preferred embodiment of the present invention.

FIG. 7 shows a partial front view of memento timepiece system 325 according to another preferred embodiment of the present invention. In the embodiment of FIG. 7, a second representative example of a remembrance event is given. Preferably, memento timepiece system 325 has been adapted to periodically assist the user in remembering specific aspects of the 9-11 events. Preferably, memento timepiece system 325 comprises memento indicia 120, in the present example memorializing members of the New York Fire Department, by depicting the F.D.N.Y. Maltese Cross, on the face of dial 112, as shown. Additionally, memento timepiece system 325 preferably comprises at least one audible alert, factory preset to periodically signal a time of user remembrance, preferably 9:11 a.m. or 9:11 p.m. Upon reading the teachings of this specification, those of ordinary skill in the art will now understand that, under appropriate circumstances, such as user preference, chosen memorial event, intended use, etc., other memento indicia, such as photographs, dimensional carvings, words, phrases, illuminations, etc., may suffice.

Figure 8:
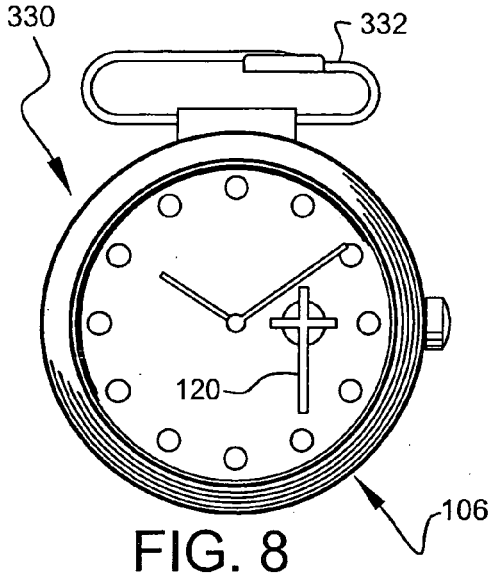
FIG. 8 shows a front view of the memento timepiece system according to another preferred embodiment of the present invention.

FIG. 8 shows a front view of memento timepiece system 330 according to another preferred embodiment of the present invention. The embodiment of FIG. 8 further illustrates preferred variations of the present invention. Preferably, memento timepiece system 330 comprises an outer case 106 having pin 332, as shown. Preferably, pin 332 is adapted to permit memento timepiece system 330 to be removably attached, by pinning through an article of clothing worn by the user (at least embodying herein wherein such housing means comprises wearability means for assisting wearability of such housing means adjacent at least one body portion of the at least one user).

Figure 9:
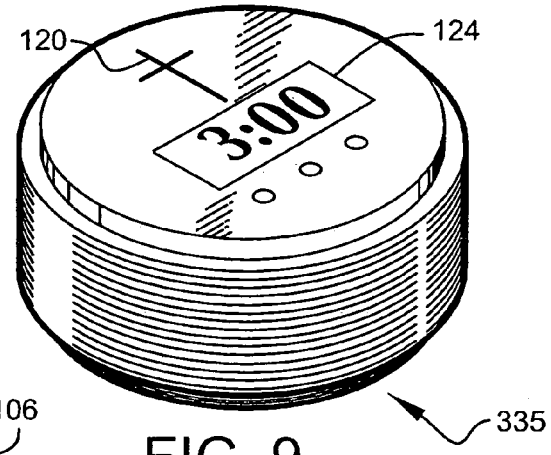
FIG. 9 shows a perspective view, illustrating the memento timepiece system as a desk clock, according to another preferred embodiment of the present invention.

FIG. 9 shows a perspective view, illustrating memento timepiece system 335, according to another preferred embodiment of the present invention. Preferably, memento timepiece system 335 comprises a digital desk clock, as shown. FIG. 9 further illustrates the adaptability of the present invention to a wide range of personal items.

Figure 10:
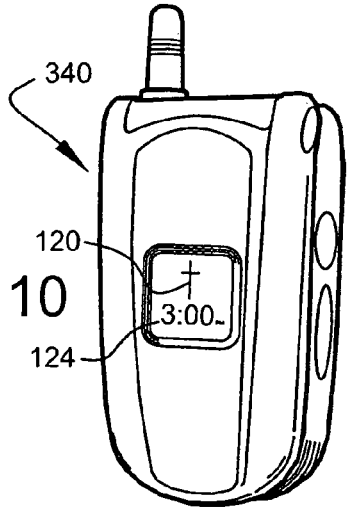
FIG. 10 shows a perspective view, illustrating the memento timepiece system as a portable communication device, according to another preferred embodiment of the present invention.

FIG. 10 shows a perspective view, illustrating a memento timepiece system 340 comprising a portable communication device, according to another preferred embodiment of the present invention. Preferably, memento timepiece system 340 (at least embodying herein wherein said memento timepiece system is housed in at least one portable communication device) is adapted to comprise a portable communication device, having an internal timekeeping function, such as the mobile phone shown. Upon reading the teachings of this specification, those of ordinary skill in the art will now understand that, under appropriate circumstances, such as user preference, advances in technology, intended use, etc., other portable communication devices, such as text pagers, Personal Digital Assistants (PDAs), etc., may suffice.

Figure 11:
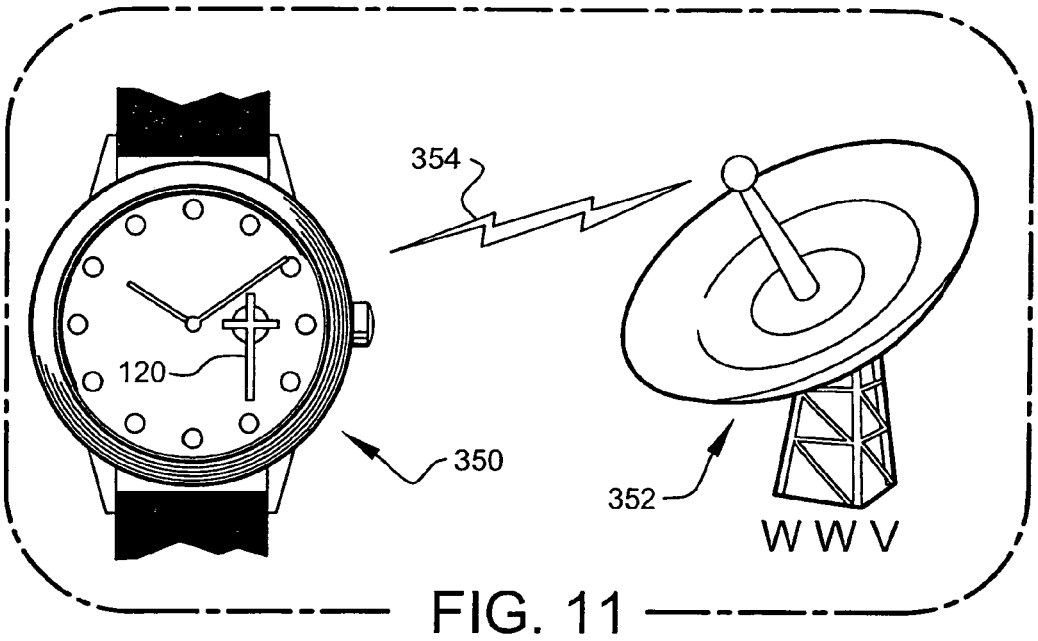
FIG. 11 shows a diagram, illustrating a memento timepiece system adapted to receive time and frequency data from a remote broadcast site, according to another preferred embodiment of the present invention.

FIG. 11 shows a diagram, illustrating automatic time setting functions of a radio-controlled memento timepiece system 350 adapted to receive wireless time and frequency data 354 from remote broadcast site 352, according to another preferred embodiment of the present invention.

Remote broadcast site 352 preferably comprises a National Institute of Standards and Technology (NIST) radiobroadcast station, as shown. Presently, NIST has established a network of radio stations to continuously broadcast time and frequency information. The broadcast information includes time announcements, standard time intervals, standard frequencies, UT1 time corrections and a Binary Code Decimal (BCD) time code. Currently, the time is kept to within less than one microsecond of Coordinated Universal Time (UTC) at the transmitter site. For most users in the United States, the accuracy of received time data is within about 10 milliseconds (1/100 of a second). Currently, the 50 kW signal from the NIST radio station WWVB located in Fort Collins, Colo. is the preferred synchronization source for memento timepiece system 350 in the United States.

Preferably, memento timepiece system 350 comprises a programmable quartz timekeeping movement similar to the movement described in FIG. 4. In addition, memento timepiece system 350 preferably comprises an antenna, a radio receiver and an internal program to receive and decode the radio signal received from remote broadcast site 352, as shown. Preferably, the programmable quartz timekeeping movement functions to time the alert signal functions of the present invention and to advance the time display during intervals in which no valid remote time data is being received by the system. Preferably, once memento timepiece system 350 has received and decoded a signal from remote broadcast site 352, timekeeping movement 132 is adapted to synchronize the internal time data of memento timepiece system 350 with the time data received from the radio signal of remote broadcast site 352 (at least embodying herein wherein such at least one timekeeper is structured and arranged to receive wirelessly time-of-day corrections, wherein more accurate time-of-day may be kept by such at least one timekeeper). Radio controlled watch movements suitable for modification and use with the present invention are available through a number of commercial sources. For example, Junghans Ounghansusa.com) produces a line of wristwatches having radio-controlled automatic setting features.

Figure 12:
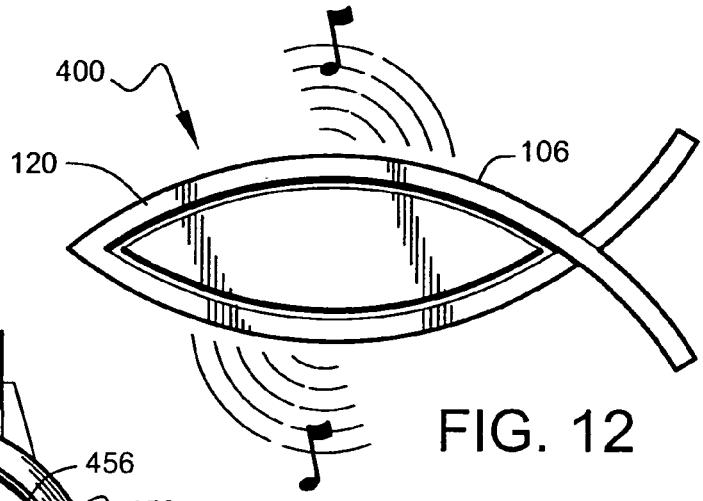
FIG. 12 shows a front view of the memento timepiece system, in a wearable configuration, solely adapted to provide daily remembrance alerts, according to another preferred embodiment of the present invention.

FIG. 12 is a front view of memento timepiece system 400, in a wearable configuration, solely adapted to provide daily remembrance alerts, according to another preferred embodiment of the present invention. In the preferred embodiment of FIG. 12, memento timepiece system 400 comprises a personal item, such as a pin, broche or paperweight, as shown. The outer housing 106 of memento timepiece system 400 may preferably comprise memento indicia 120 in the form of a symbol or shape, as shown. Preferably, housing 106 contains a programmable quartz movement with a radio-controlled automatic time setting feature as described in FIG. 1. Preferably, memento timepiece system 400 is factory programmed to provide the user with an alert signal at the prescribed remembrance times. Because memento timepiece system 400 is automatically set, the system requires no external time displays, as shown. Preferably, memento timepiece system 400 (embodying herein wherein said memento timepiece systems comprises no external time displays) functions solely as an alert device to assist the user in daily acts of remembrance.

Figure 13:
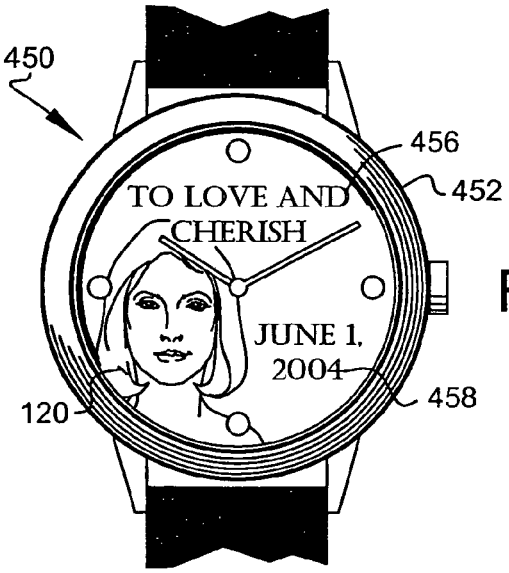
FIG. 13 shows a front view of a custom memento timepiece system according to another preferred embodiment of the present invention.

FIG. 13 is a front view of custom memento timepiece system 450 according to another preferred embodiment of the present invention. Preferably, custom memento timepiece system 450 comprises wristwatch 452 having user specific remembrance features, as shown. For illustrative purposes, the depicted embodiment has been uniquely customized to assist a specific user in the remembrance of a wedding, as shown. In the present example, custom memento timepiece system 450 is depicted with a user supplied momento indicia 120 (a photographic image), user selected phrase indicia 456 and user selected date indicia 458. Preferably, custom memento timepiece system 450 may further comprise an audible alert, factory preset to the user's specification. Upon reading the teachings of this specification, those of ordinary skill in the art will now understand that, under appropriate circumstances, considering user preference, remembrance subject matter, memento timepiece configuration, etc., the use of other remembrance aides, such as visual illuminations, carvings, animations, colors, audible tones, etc., may suffice.

Figure 14:
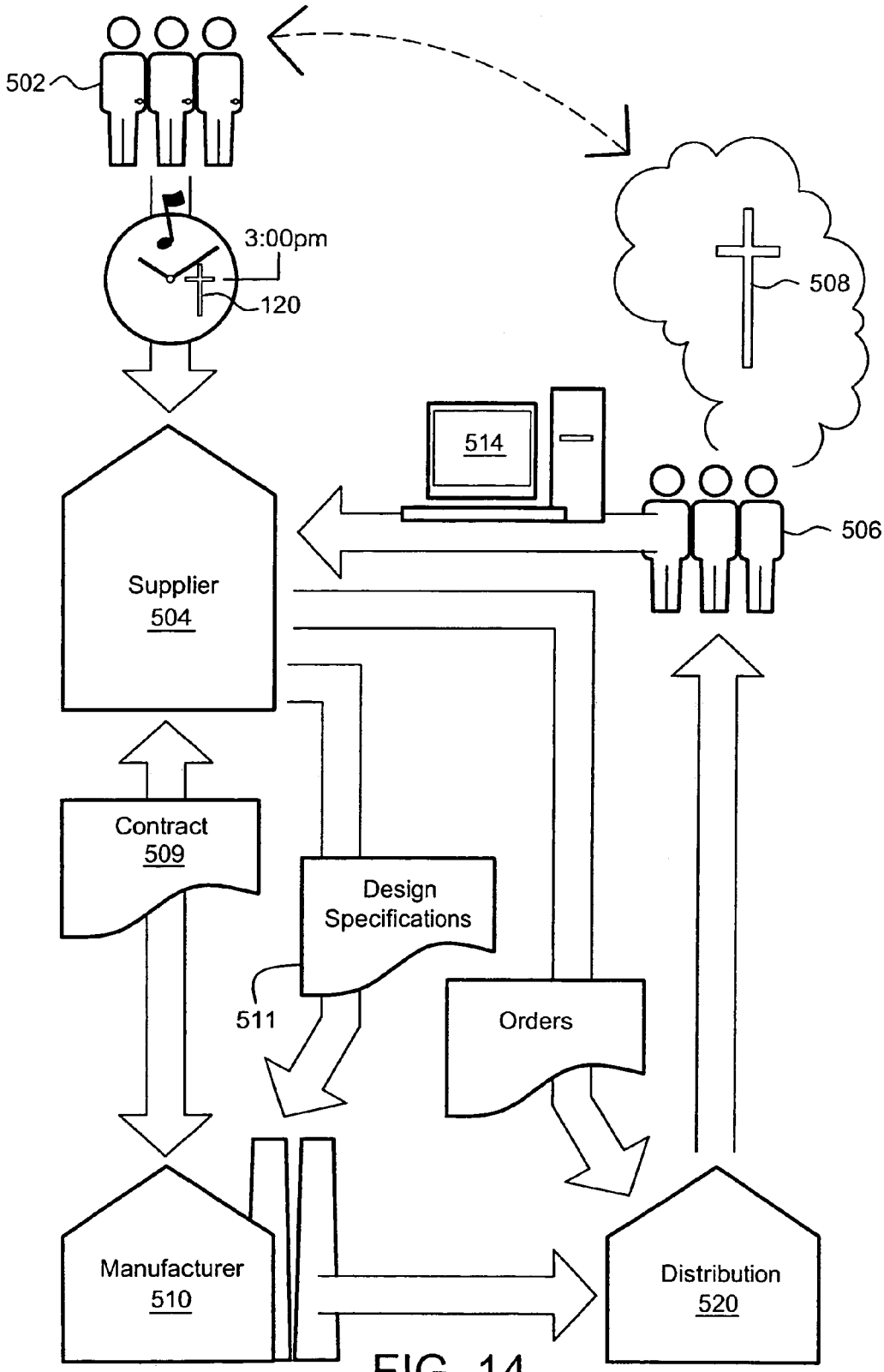
FIG. 14 shows a flowchart diagram, generally illustrating a method of producing and distributing memento timepiece systems, according to the preferred embodiments of FIG. 1 through FIG. 12.

FIG. 14 is a diagram, generally illustrating a business method related to producing and distributing memento timepiece systems, according to the preferred embodiments of FIG. 1 through FIG. 12. The preferred method of manufacturing, distributing and selling the memento timepiece systems is presented in the following steps.

In a first preferred step, a designer or design team 502, associated with supplier 504, identifies a needs within group 506 relating to assisting members of group 506 in acts of remembrance. Preferably, the need will be associated with a person or event 508 memorable to group 506, as shown. Preferably, design team 502 selects imagery relating to the person or event to produce appropriate memento indicia 120. Preferably, design team 502 may work with members of the group to identify memento indicia 120 having the greatest value and meaning to the group members. Preferably, the design team 502 selects an appropriate alert signal and signal time, as shown. Preferably, a final design is selected, and specifications 511 for the design are generated, as shown. Preferably, supplier 504 identifies manufacturer 510 and negotiates contract 509 to batch produce the memento timepiece system based on specifications 511, as shown. Preferably, specifications 511 will include physical dimensions, materials requirements, memento indicia, packaging materials, operational parameters, user instructions, etc. for producing the system. Preferably, manufacturer 510 produces the memento timepiece systems, based on the specification requirements. Preferably, manufacturer 510 flashes or otherwise downloads all alert signal programming to the memento timepiece systems and ships the finished units to product distribution site 520, as shown. Upon reading the teachings of this specification, those of ordinary skill in the art will now understand that, under appropriate circumstances, such as supplier preference, methods of programming, supply logistics, etc., programming of the memento timepiece systems by the supplier prior to customer delivery may suffice.

Preferably, supplier 504 operates one or more Internet website servers 514 offering the memento timepiece systems for sale, as shown. Preferably, supplier 504 provides for acceptance of orders and payment from individuals of group 506 for purchase of the memento timepiece systems by means of the website. In a final preferred step, supplier 504 provides for the shipping of ordered memento timepiece systems to purchasing individuals of group 506, from product distribution site 520, thus completing the transaction.

Thus, it is seen that the above steps embody and provide herein a business method relating to the daily observance of at least one event memorable to a plurality of individuals, comprising the steps of: identifying such at least one event memorable to such plurality of individuals; providing for the manufacture of at least one memento timepiece system providing at least one daily reminder of such at least one event memorable to such plurality of individuals; operating an Internet website server offering to sell such at least one memento timepiece system; providing for acceptance of orders and payment from at least one of such plurality of individuals for such memento timepiece system; and providing for shipping such ordered memento timepiece system to such at least one of such plurality of individuals.

Figure 15:
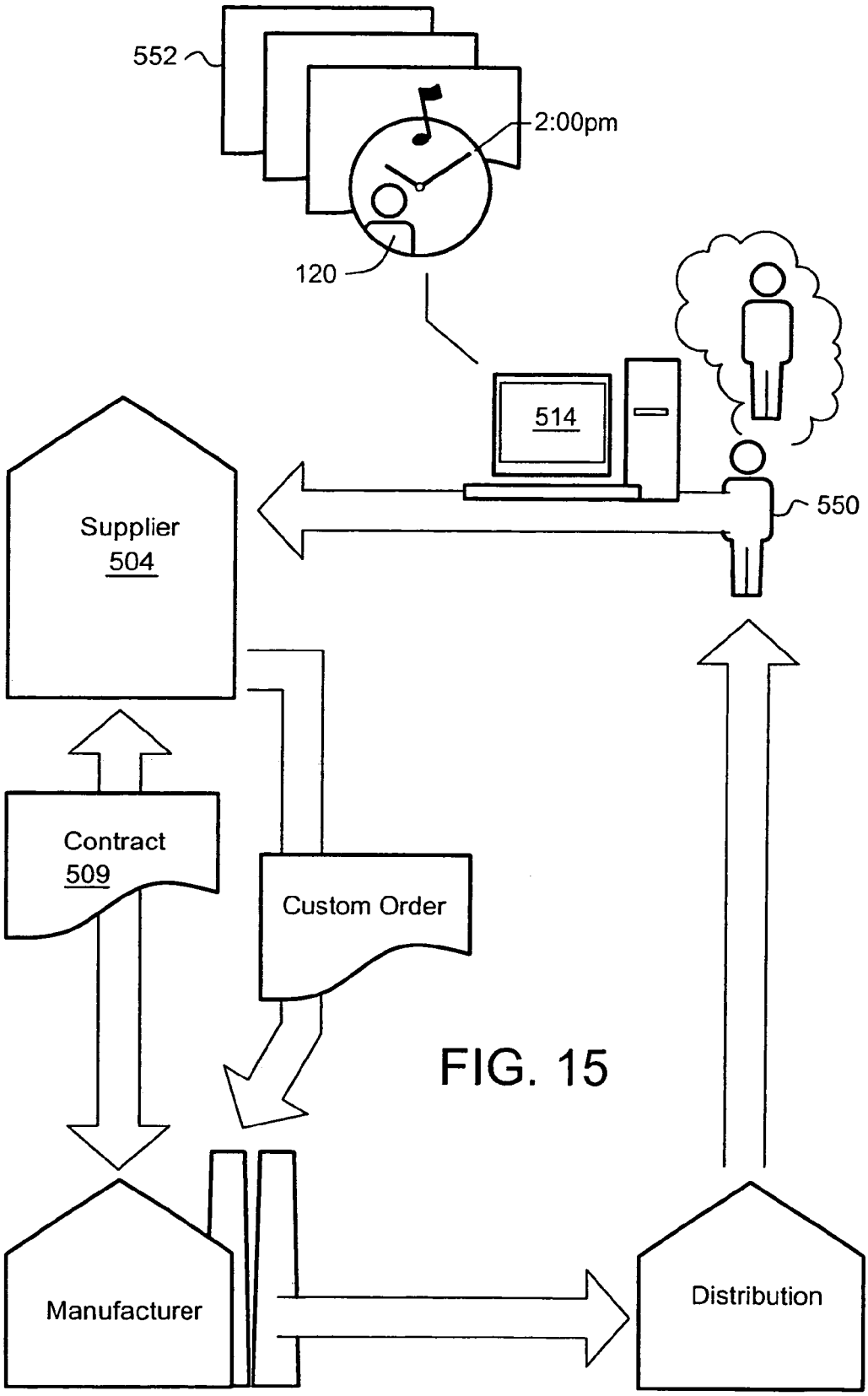
FIG. 15 shows a flowchart diagram, generally illustrating a method of producing and distributing custom memento timepiece systems, according to the preferred embodiment of FIG. 13.

FIG. 15 shows a diagram, generally illustrating a business method related to producing and distributing custom memento timepiece systems, according to the preferred embodiments of FIG. 13. In a second preferred business method, supplier 504 preferably operates one or more Internet website servers 514 offering to provide custom memento timepiece systems for production and sale, as shown. Preferably, Internet website server 514 comprises a website adapted for the acceptance of orders and purchase transactions, from individuals 550, for custom designed memento timepiece systems. Preferably, the website is structured to permit individuals 550 to select and specify specific designs for producing a single unit or limited quantities of the custom memento timepiece system. For example, individual 550 preferably accesses Internet website server 514 and selects, from customization menu 552, a timepiece to be customized, memento indicia 120 and a daily alert signal time. Individual 550 preferably completes the order by providing payment and shipping information. In addition, the website is preferably adapted to permit individual 550 to upload a photograph or other image file for use as memento indicia 120 (as illustrated in FIG. 13). Preferably, supplier 504 arranges for production of the custom memento timepiece system, using the customization data provided by individual 550. In a final preferred step, supplier 504 provides for the shipping of the custom memento timepiece system to individual 550, thus completing the transaction.

Thus, it is seen that the above steps embody and provide herein a business method relating to the daily observance of at least one event memorable to a plurality of individuals, comprising the steps of: accepting at least one custom order for at least one memento timepiece system to provide at least one daily reminder of at least one event memorable to a specific individual; and providing for the manufacture of such at least one custom memento timepiece system.

Figure 16:
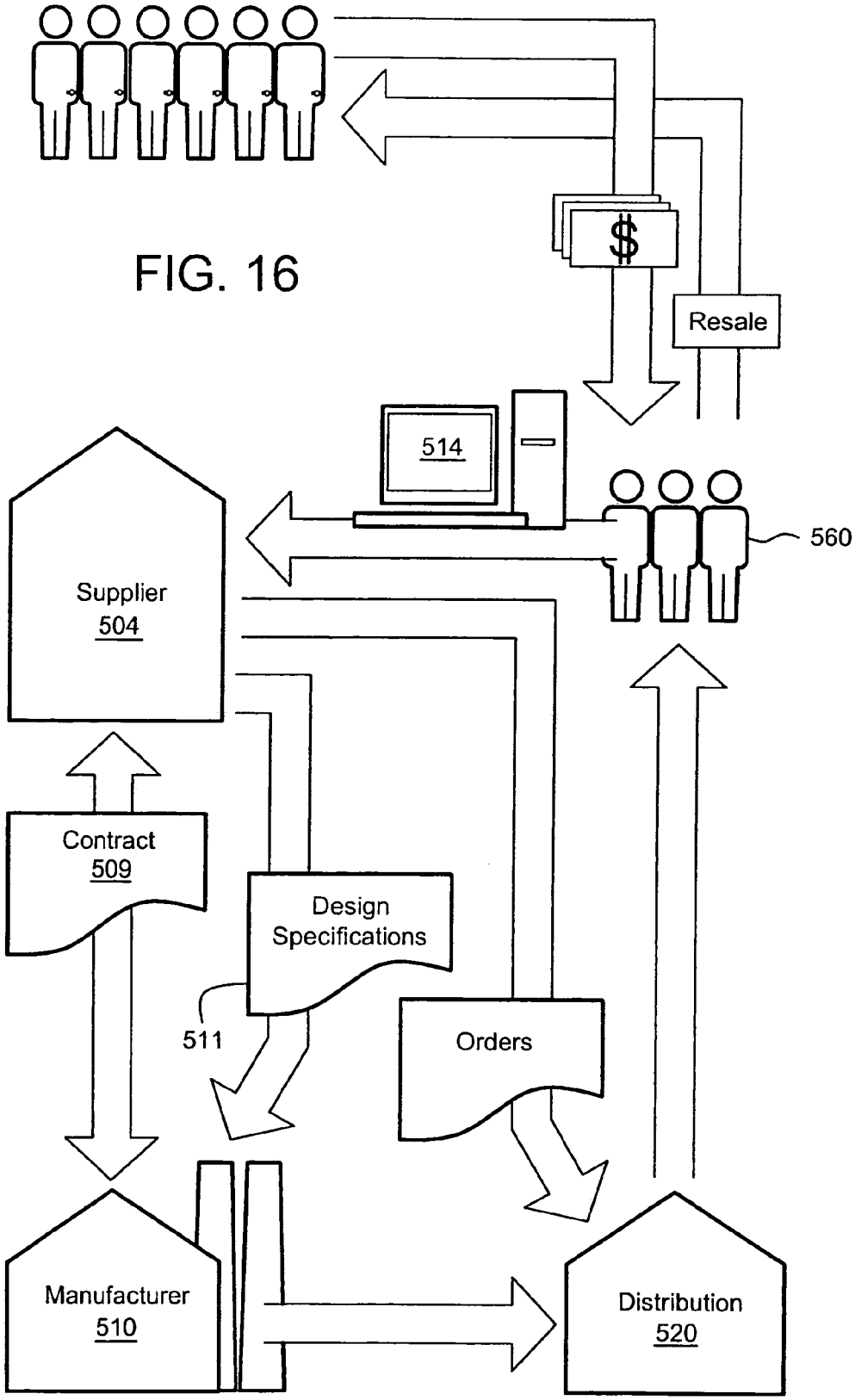
FIG. 16 shows a diagram, generally illustrating a business method related to producing and distributing memento timepiece systems, according to the preferred embodiments of the present invention.

FIG. 16 shows a diagram, generally illustrating a business method related to producing and distributing memento timepiece systems, according to the preferred embodiments of the present invention. The preferred method of manufacturing, distributing and selling the memento timepiece systems is presented in the following steps.

Preferably, supplier 504 operates one or more Internet website servers 514 offering the memento timepiece systems for sale to non-profit group 560, as shown. Preferably, supplier 504 provides for acceptance of orders and payment from non-profit group 560 for purchase of the memento timepiece systems, at a wholesale rate, essentially to assist non-profit group 560 to carry out a revenue-producing resale of the memento timepiece systems. In a final preferred step, supplier 504 provides for the shipping of ordered memento timepiece systems to non-profit group 560, thus completing the purchase transaction. Non-profit group 560 may then resale the memento timepiece systems to produce fundraising profits. In the above-described method, non-profit group 560 may preferably select the memento timepiece systems from the suppliers standard stock or may order a quantity of custom memento timepiece systems.

Thus, it is seen that the above steps embody and provide herein a business method relating to the daily observance of at least one event memorable to members of at least one non-profit group, comprising the steps of: identifying such at least one event memorable to such members of the at least one non-profit group; providing for the manufacture of at least one memento timepiece system providing at least one daily reminder of such at least one event memorable to such members of the at least one non-profit group; operating an Internet website server offering to sell such at least one memento timepiece system to such members individuals of the at least one non-profit group; providing for acceptance of orders and payment from at least one of such members for such at least one memento timepiece system, at a wholesale rate, essentially to assist such at least one non-profit group to carry out at least one revenue producing resale of such at least one memento timepiece system; and providing for shipping such ordered timepiece system to such members of such at least one non-profit group.

Although applicant has described applicant's preferred embodiments of this invention, it will be understood that the broadest scope of this invention includes such modifications as diverse shapes and sizes and materials. Such scope is limited only by the below claims as read in connection with the above specification.

Further, many other advantages of applicant's invention will be apparent to those skilled in the art from the above descriptions and the below claims.

What is claimed is:

1. Memento timepiece systems, relating to at least one daily observance of at least one religious event memorable to at least one user, comprising: a) at least one timekeeper adapted to keep current time-of-day data; b) at least one alerter adapted to provide at least one daily user alert as at least one memento of the at least one religious event memorable to the at least one user; mid c) at least one alert initiator, coupled with said at least one alerter and coupled with said at least one timekeeper, adapted to initiate the at least one daily user alert by said at least one alerter; and d) at least one displayer adapted to display at least one Christian religious symbol; e) wherein the at least one Christian religious symbol and the time of day at which the at least one user daily alert is initiated are both associated with the same Christian religious event wherein said at least one alert initiator further comprises at least one factory presetter adapted to factory preset, in a manner not user-modifiable, the initiating of the at least one daily user alert, as the at least one memento of the at least one event memorable to the at least one user, at at: least one preset daily (24-hour timekeeper day) time-of-day according to said at least one timekeeper; wherein said memento timepiece systems comprise no external time displays.

* * * * *